United States Patent [19]

Imose et al.

[11] Patent Number: 4,743,196

[45] Date of Patent: May 10, 1988

[54] CONTINUOUS ANNEALING FURNACE FOR A STRIP

[75] Inventors: Masayuki Imose, Kawanishi; Yuji Fujiwara, Ikoma; Yoshito Sakaguchi, Kyoto, all of Japan

[73] Assignee: Chugai Ro Co., Ltd., Osaka, Japan

[21] Appl. No.: 870,429

[22] Filed: Jun. 4, 1986

[30] Foreign Application Priority Data

Jun. 10, 1985 [JP] Japan ..... 60-125527
Jun. 10, 1985 [JP] Japan ..... 60-125528
Jun. 10, 1985 [JP] Japan ..... 60-125529

[51] Int. Cl.[4] ..... F27D 15/02; F27B 9/28

[52] U.S. Cl. ..... 432/59; 266/103; 432/8

[58] Field of Search ..... 432/8, 59; 266/103, 266/105, 106

[56] References Cited

U.S. PATENT DOCUMENTS

| | | | |
|---|---|---|---|
| 2,666,003 | 1/1954 | Dougherty et al. | 432/59 |
| 3,328,997 | 7/1967 | Beggs et al. | 72/342 |
| 3,385,946 | 5/1968 | Hatchand | 432/59 |
| 3,477,138 | 11/1969 | Snow | 432/8 |
| 3,744,963 | 7/1973 | Flynn | 432/59 |
| 3,837,790 | 9/1974 | Pierson | 432/59 |
| 4,243,441 | 1/1981 | Wilson | 432/8 |
| 4,316,717 | 2/1982 | Thome | 432/8 |
| 4,501,553 | 2/1985 | Imose et al. | 432/8 |
| 4,568,274 | 2/1986 | Imose et al. | 432/59 |
| 4,595,357 | 6/1986 | Sato et al. | 432/59 |

FOREIGN PATENT DOCUMENTS

| | | |
|---|---|---|
| 20785 | 9/1964 | Japan . |
| 38782 | 11/1979 | Japan . |
| 18053 | 4/1981 | Japan . |
| 37291 | 8/1981 | Japan . |
| 20379 | 4/1982 | Japan . |
| 53052 | 11/1983 | Japan . |
| 42732 | 10/1984 | Japan . |

*Primary Examiner*—Henry C. Yuen
*Attorney, Agent, or Firm*—Wenderoth, Lind & Ponack

[57] ABSTRACT

A continuous annealing furnace for a strip which is provided with a first treating furnace of horizontal type including at least a heating zone and a soaking zone, and a second treating furnace of vertical type disposed adjacent to the first treating furnace. The first treating furnace further includes a floating type transporting means which is composed of plural stages of floating type supporting devices for supporting the strip to be treated on them in a floating state, and a plurality of direction changing devices for transporting the strip from an upper stage towards a lower stage of the supporting devices, and the second treating furnace includes a plurality of rolls for transporting the material in a zigzag manner on vertically arranged multi-row passage. In this continuous annealing furnace, the strip is applied with an annealing treatment by being sequentially passed within the first and subsequent second treating furnaces, with the tension on the strip being controlled independently in each treating furnace by a plurality of bridle roll devices which are arranged at an inlet side of the first treating furnace, at an outlet side of the second treating furnace and a connecting portion between the first and the second treating furnaces.

2 Claims, 2 Drawing Sheets

CONTINUOUS ANNEALING FURNACE FOR A STRIP

BACKGROUND OF THE INVENTION

The present invention generally relates to an annealing process and more particularly, to a continuous annealing furnace for annealing a strip at relatively high speed, with the strip being kept superior in tracking properties, even though it is thin.

Conventionally, a continuous annealing furnace for a steel strip has been generally classified into a horizontal type or vertical type. Either one of totally horizontal type, multilayer type, L-shaped type, inclined type, combination type of horizontal and vertical types, and totally vertical type is selected as a furnace type according to production capacity of a material to be treated, kind thereof, object of treatment therefor or the like.

Furthermore, in a transporting means for the strip in the continuous annealing furnace, there exist transport systems of roll type, catenary type, floating type or the like.

Meanwhile, when the strip is produced through the continuous annealing treatment at a throughput of 20,000 to 40,000 tons a month, as disclosed in Japanese Patent Publication Tokkosho No. 59-42732, a totally vertical type furnace wherein each of a heating zone, a soaking zone, a first cooling zone (an overaging treating zone) and a last treating zone is vertically arranged, is generally employed in achieving the above described capacity.

Moreover, a combination of horizontal type furnace and vertical type furnace is occasionally employed for the continuous annealing furnace, as disclosed in Japanese Patent Publication Tokkosho No. 56-18053 wherein a direct firing type heating zone is horizontally arranged and other zones are vertically arranged, or as disclosed in Japanese Patent Publication Tokkosho No. 58-53052 wherein, after quenching treatment of the material, the material is led into an overaging treating zone which is a horizontal type furnace having horizontal multi-row passage for the material. In each of the continuous annealing furnaces as described in the aforementioned disclosures, the strip is passed within the furnace so as to be subjected to the annealing treatment, while it is supported by rolls.

In addition, there also exists another combination type furnace wherein the heating zone and the soaking zone are arranged in the horizontal type furnace and the cooling zone is arranged in the vertical type furnace and furthermore, bridle roll means are provided at an inlet side of the horizontal type furnace and at an outlet side of the vertical type furnace so as to control the strip in tension.

However, in this kind of the continuous annealing furnace, or in the totally vertical type furnace which is effectively employed for continuous annealing at a monthly production of 20,000 to 40,000 tons per unit as stated hereinbefore, and in decreasing the installation space thereof, it is extremely difficult to conduct heat treatment of for example, a thin strip having a thickness of 0.07 mm and a width of 1,270 mm at such a relatively high speed as 600 m/min.

That is to say, although the strip is necessarily applied with a tension of, for example, 0.5 to 1.0 kg/mm$^2$ in order not only to be steadily transported at the aforementioned speed without meandering thereof, but also to keep the superior tracking properties thereof, such tension results in that a constriction (a heat buckle or a tension buckle) is undesirably produced on the strip in a portion of the annealing furnace which is high in temperature.

Furthermore, since the strip is controlled to be constant in tension as a whole by the bridle roll means arranged at both inlet and outlet sides of the annealing furnace as described hereinbefore, the strip is naturally limited in size. In dimensions, the strip is limited to be approximately 0.15 mm in thickness and approximately 920 mm in width and as a result, it is practically impossible to conduct the continuous annealing treatment on the strip having a thickness smaller than the above described value or that having a width larger than the above described value.

Moreover, since a plurality of rolls are employed for the transporting means, there has been a drawback that in order to prevent the occurrence of construction of the strip, such a countermeasure is required as to eliminate temperature difference between the material and the rolls arranged in the heating zone and the soaking zone.

On the other hand, in the combination type continuous annealing furnace of the horizontal and the vertical types, although the occurrence of constriction can be decreased to some extent, as compared with a totally vertical type furnace owing to the fact that the tension on the strip in the horizontal type furnace is relatively smaller than that in the vertical type furnace, there has been such a problem that not only a large number of transporting rolls are necessarily required, but also the strip is liable to be undesirably damaged by the rolls.

The present invention has been developed in view of the facts that the occurrence of constriction of the material is caused by the tension applied thereon and the heating conditions therefor in the heating zone and the soaking zone, and the material is limited in size by the amount of the tension exerted thereon which is required for steady transportation thereof in the aforementioned zones, and the heat buckle or the tension buckle tends to occur in the heating and the soaking treatments of the material.

Furthermore, the present invention has also been developed on the basis of the facts that the strip in the horizontal type furnace can be decreased in tension relatively smaller than that in the vertical type furnace, and the continuous annealing furnace can be decreased in installation space thereof by arranging a portion of the material which is relatively low in temperature, in the vertical type furnace, and the tension of the material in each furnace of the combination type can be independently controlled by arranging additional bridle roll means between both furnaces.

SUMMARY OF THE INVENTION

Accordingly, an essential object of the present invention is to provide an improved continuous annealing furnace for a strip wherein the strip can be independently controlled in tension both in a first treating furnace of horizontal type and in a second treating furnace of vertical type for steadily transporting the strip without occurrence of such a constriction thereof as a heat buckle or a tension buckle.

Another important object of the present invention is to provide a continuous annealing furnace for a strip of the above described type wherein the space required for installation thereof can be relatively reduced.

In accomplishing these and other objects, according to one preferred embodiment of the present invention, there is provided a continuous annealing furnace for a strip which includes a first treating furnace having at least a heating zone and a soaking zone therein, a second treating furnace connectively arranged with the first treating furnace, a floating type transporting means disposed in the first treating furnace for transporting the strip in a floating state thereon and a roll transporting means disposed in the second treating furnace, wherein the strip is subjected to an annealing treatment by being sequentially passed within the first and subsequent second treating furnaces, with the strip being transported on multi-row passage vertically arranged at least in a zone adjacent the outlet portion of the second treating furnace.

BRIEF DESCRIPTION OF THE DRAWINGS

These and other objects and features of the present invention will become more apparent from the following description taken in conjunction with the preferred embodiment thereof with reference to the accompanying drawings, in which.

DETAILED DESCRIPTION OF THE INVENTION

Figure 1:
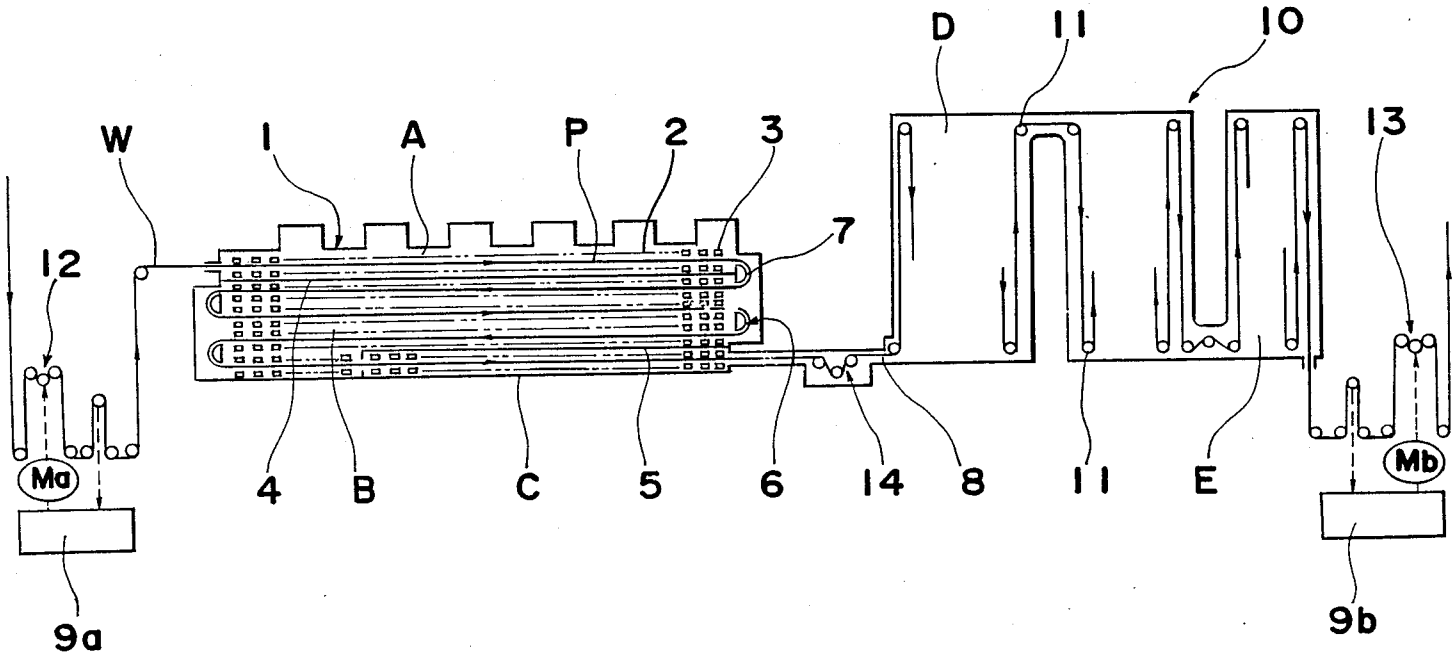
FIG. 1 is a schematic diagram of a continuous annealing furnace for a strip according to one preferred embodiment of the present invention.

Before the description of the present invention proceeds, it is to be noted that like parts are designated by like reference numerals throughout the accompanying drawings.

Referring now to the drawings, there is shown in FIG. 1, a continuous annealing furnace for annealing a strip according to one preferred embodiment of the present invention. The annealing furnace generally includes a first treating furnace 1 of horizontal type and a second treating furnace 10 of vertical type.

In the first treating furnace 1, there is provided a floating type transporting means having floating type horizontal supporting devices 2 in a plurality of stages for supporting a material W to be treated thereon in a floating state, and a plurality of direction changing devices 6 for transporting the material from an upper stage of the supporting device 2 towards a lower stage thereof, with the material being composed of a strip.

Each of the floating type supporting devices 2 includes a plurality of static pressure pads arranged on upper and lower sides of a passage for the material W, which pads are known in, for example, U.S. Pat. No. 3,328,997, and have a function to support the material W thereon in the floating state by static pressure which arises from gas injecting inwardly from a plurality of nozzles (not shown) towards both surfaces of the material W, while the material is similarly heated by the gas which is high both in temperature and pressure.

Hereupon, the plural stages of the supporting devices 2 are vertically arranged one upon another at regular intervals in this embodiment, and the first treating furnace 1 is divided by separating walls 4, 5 into three zones, that is, a heting zone A, a soaking zone B and a first cooling zone C. Furthermore, each zone is supplied with the gas at a desired temperature corresponding to the respective zone through the static pressure pads 3.

As disclosed in Japanese Patent Publication Tokkosho No. 39-20785 or No. 54-38782, each of the direction changing devices 6 disposed at end portions of the passages P and a function to transport the strip from an upper stage towards a lower stage, while the strip is kept in a state wherein it is out of contact with the direction changing devices 6 by the gas injection from curved guide plates 7, each of which is arranged on the outside surface thereof.

The above described supporting devices 2 and the direction changing devices 6 may be replaced by rolls.

Although, in this embodiment, the first treating furnace 1 is divided into three quarters zones, there may be provided at least the heating zone A and the soaking zone B in the first treating furnace 1, and the passages P for the material W are not limited in multistage arrangement.

The second treating furnace 10 is arranged adjacent to the first treating furnace 1 and includes an overaging treating zone D and a second cooling zone E. Each of the zones D and E is vertically arranged in the second treating furnace 10 and is provided with a plurality of upper and lower rolls 11 spaced at required distance therein so as to transport the material W in a zigzag manner wherein the material W is alternately wound around each of upper and lower rolls 11. In addition, a heating and a cooling means (not shown) are also arranged in each zone D or E.

In this embodiment, although the material W is transported on multi-row passage vertically defined in the second treating furnace 10 is a manner that the transporting direction thereof is repeatedly changed in a vertical direction between the upper and lower rolls 11 in each zone D or E, it may be transported in the same manner as described above at least in the last zone which is the second cooling zone E in this embodiment.

Besides, a plurality of bridle roll means 12, 13 and 14 are respectively arranged at an inlet side of the first treating furnace 1, at an outlet side of the second treating furnace 10 and at a connecting portion 8 between the first and the second treating furnaces 1, 10 for controlling the tension exerted on the material W. Thension detectors *9a* and *9b* are provided, each including a dancer roll and the like, and driving motors Ma and Mb are provided for the bridle roll means 12 and 13.

The tensions of the material W in the first and the second treating furnaces 1 and 10 are controlled in a manner that the bridle roll means 12 and/or 13 are controlled by the driving motors Ma and/or Mb respectively through signals from the tension detectors *9a* and/or *9b* on the basis of the bridle roll means 14, or upon detection of the tension of the material W in each treating furnace 1 or 10 by a tension detecting means (not shown) arranged in the vicinity of the bridle roll means 14, the bridle roll means 14 is controlled by a driving motor (not shown) on the basis of either of the bridle roll means 12 and 13, or in a manner that the tension of the material W is controlled by the driving motors Ma and/or Mb. More specifically, the tensions of the material W in the first and the second treating furnaces 1 and 10 are controlled so that the former is smaller than the latter, for example, the former is 0.15 to 0.4 $kg/mm^2$ and the latter is 0.5 to 1.0 $kg/mm^2$.

A heat treatment in the continuous annealing furnace having the construction as described so far will be explained hereinafter.

As shown in heat curve (a) of FIG. 2, a soft tinplate which is the material W to be treated is heated up to an annealing temperature in the heating zone A and is subsequently held at the same temperature during a required period in the soaking zone B. Thereafter, the material W is quenched down to an overaging temperature in the first cooling zone C and upon subsequent overaging treatment thereon, the material W is cooled down to approximately the ambient temperature in the second cooling zone E.

It has been found that when the material W having a thickness of 0.05 to 0.5 mm and a width of 600 to 1,500 mm is treated at a transportation speed of 700 m/min, the continuous annealing treatment can be conducted on the material W without occurrence of constriction thereof owing to the tension exerted thereon which is set to be approximately 0.3 kg/mm$^2$ in the heating zone A, the soaking zone B and the first cooling zone C.

Figure 2:
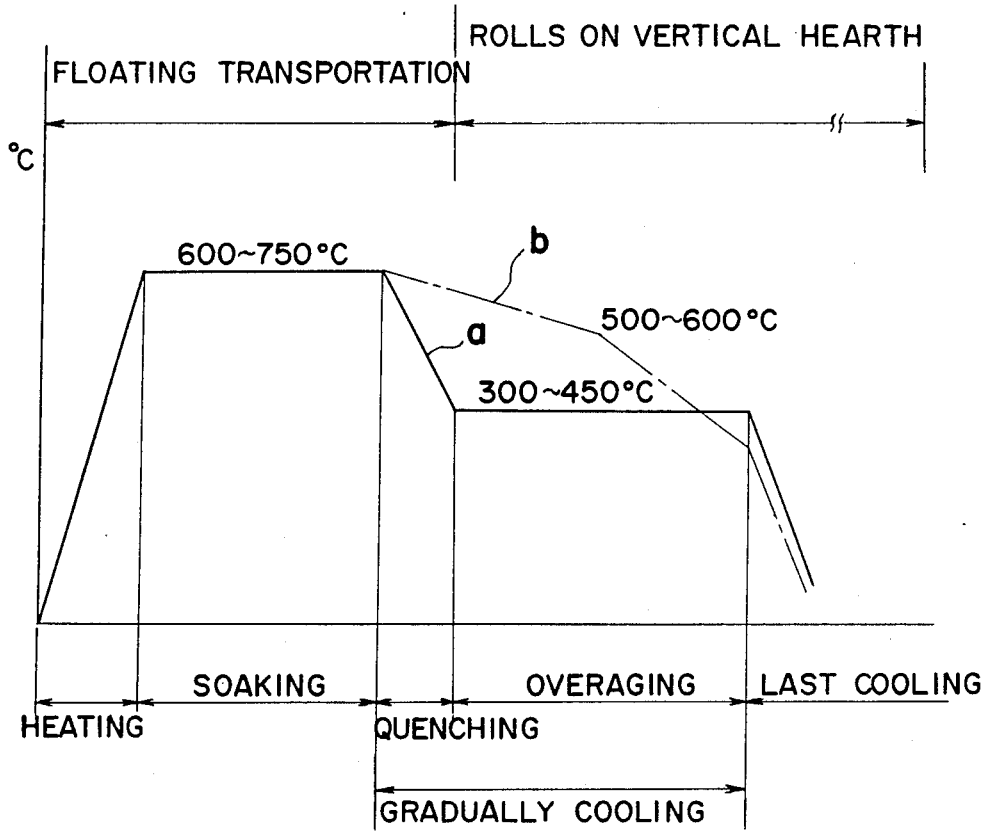
FIG. 2 is a heat curve, in accordance with which a material to be treated is subjected to a heat treatment.

Furthermore, if the first cooling zone C and the overaging treating zone D are caused to have functions to gradually decrease the temperature of the material W, a hard tinplate can also be subjected to the continuous annealing treatment in the same annealing furnace, as shown in a heat curve (b) of FIG. 2.

It is to be noted that a variety of metallic strips other than those described above can also be treated in the continuous annealing furnace according to the present invention.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A continuous annealing furnace for a strip comprising:

a horizontally arranged first treating furnace having inlet and outlet portions, a floating type supporting means therein for supporting the strip in a floating state, means therein for heating the strip, and means therein for soaking the strip;

a vertically arranged second treating furnace having inlet and outlet portions, means therein for overaging the strip, means therein for cooling the strip, and a plurality of roll members therein for supporting the strip and being connectively disposed, through a connecting portion, at said outlet portion of said first treating furnace; and a plurality of bridle roll means respectively located at said inlet portion of said first treating furnace, said connecting portion and said outlet portion of said second treating furnace to regulate tension exerted on the strip;

whereby during operation of said furnace the strip is at least heated up to and soaked at an annealing temperature in a floating state within said first treating furnace, and is subjected to an annealing treatment by being caused to sequentially pass through said first and subsequent second treating furnaces, with a lower tension being exerted on the strip in said first treating furnace than in said second treating furnace by controlling said bridle roll means.

2. A continuous annealing furnace for a strip as claimed in claim 1, wherein the tension exerted on the strip in said first treating furnace is regulated to be 0.15 to 0.4 kg/mm$^2$ by said bridle roll means located at said inlet portion of said first treating furnace and said connecting portion, and the tension exerted on the strip in said second treating furnace is regulated to be 0.5 to 1.0 kg/mm$^2$ by said bridle roll means located at said connection portion and said outlet portion of said second treating furnace.

* * * * *